US007730585B2

(12) United States Patent
Nagel

(10) Patent No.: US 7,730,585 B2
(45) Date of Patent: Jun. 8, 2010

(54) STOP MODULE FOR A SWIVELING UNIT FOR DELIMITING A SWIVELING MOTION AND CORRESPONDING SWIVELING UNIT

(75) Inventor: Marcel Nagel, Nordheim (DE)

(73) Assignee: Schunk GmbH & Co. KG Fabrik fuer Spann- und Greifwerkzeuge, Lauffen am Neckar (DE)

( * ) Notice: Subject to any disclaimer, the term of this patent is extended or adjusted under 35 U.S.C. 154(b) by 930 days.

(21) Appl. No.: 10/593,416

(22) PCT Filed: Mar. 23, 2005

(86) PCT No.: PCT/EP2005/003087

§ 371 (c)(1),
(2), (4) Date: Sep. 19, 2006

(87) PCT Pub. No.: WO2005/095804

PCT Pub. Date: Oct. 13, 2005

(65) Prior Publication Data

US 2007/0204432 A1 Sep. 6, 2007

(30) Foreign Application Priority Data

Mar. 23, 2004 (DE) ..... 10 2004 015 823

(51) Int. Cl.
*E05D 11/10* (2006.01)

(52) U.S. Cl. ..... 16/319; 16/239; 16/82

(58) Field of Classification Search ..... 16/286, 16/239, 374, 343, 319, 375, 82, 50, 54, DIG. 17; 188/290

See application file for complete search history.

(56) References Cited

U.S. PATENT DOCUMENTS

| | | | | |
|---|---|---|---|---|
| 4,550,470 | A * | 11/1985 | Omata | 16/85 |
| 4,893,522 | A * | 1/1990 | Arakawa | 464/180 |
| 5,064,033 | A * | 11/1991 | Koike et al. | 188/306 |
| 6,390,255 | B2 | 5/2002 | Kobori | |
| 7,066,308 | B2 * | 6/2006 | Kanno et al. | 188/290 |

FOREIGN PATENT DOCUMENTS

| | | |
|---|---|---|
| DE | 198 25 969 | 10/1999 |

* cited by examiner

*Primary Examiner*—William L. Miller
(74) *Attorney, Agent, or Firm*—Paul Vincent

(57) ABSTRACT

The invention relates to a stop module for the swiveling motion of a rotation body (14) that is swivelably received in a housing (10). The stop module comprises a catch (26) following the trajectory of the swiveling motion on the end of the rotation body and a stop (48) comprising a damping element for delimiting the motion of the catch (26). At least one intermediate element (56) is provided between the catch (26) and the stop (48) and is supported, when impinged upon by the catch (26), on the housing (10) and on the stop (48).

12 Claims, 4 Drawing Sheets

STOP MODULE FOR A SWIVELING UNIT FOR DELIMITING A SWIVELING MOTION AND CORRESPONDING SWIVELING UNIT

This application is the national stage of PCT/EP2005/003087 filed on Mar. 23, 2005 and also claims Paris Convention priority of DE 10 2004 015 823.1 filed on Mar. 23, 2004.

BACKGROUND OF THE INVENTION

The invention concerns a stop module for delimiting the pivot motion of a rotation body which is pivotably disposed in a housing, comprising a catch on the side of the rotation body, which follows the trajectory of the pivot motion, and a stop which is provided on the housing side and comprises a damping element for delimiting the motion of the catch, wherein the stop is in the circular or circular segment-shaped trajectory of the catch. The invention also concerns a pivot unit comprising such a stop module.

Conventional stop modules in gripping technology are disposed e.g. between a pivot drive and a component to be pivoted, e.g. a gripping or tensioning means. The stop modules may delimit a predeterminable pivot angle, which permits exact pivoting of the rotation body or a component disposed on the rotation body to a certain position. In particular, stock absorbing elements are conventionally used as a stop, onto which the catch of the rotation body impinges.

A so-called impeller drive may e.g. be used as a pivot drive, wherein a cylinder is divided into two pressure chambers by an impeller, which is radially disposed in the cylinder, and with a stationary separating piece. Depending on the load exerted on one of the pressure chambers, the impeller is pivoted about the longitudinal axis of the cylinder, causing a corresponding pivot motion of a rotation body which is rotationally coupled to the impeller. The invention is clearly not limited to impeller drives but may be used for other drives, e.g. toothed rack drives.

DE 198 25 969 A1 discloses a means for transmitting a rotary motion from a chain guided about a chain wheel in a housing, which comprises balls which are securely interconnected by a chain chord. The chain and chain wheel thereby undergo forced guidance. The chain chord is required in the conventional device to prevent blocking of the balls on the chain wheel. The conventional device requires a relatively large amount of space due to the chain chord and the remote damping pistons.

U.S. Pat. No. 6,390,255 B2 discloses a rotary damper with a catch which can be moved in a viscous liquid, wherein the catch carries along a U-shaped damping valve which impinges on a spacer.

It has turned out that the service life of the stops or the associated shock-absorbers of the above-mentioned conventional stop modules is relatively short. It has proven to be particularly critical, when the catch impinges on the bumper at an inclined angle and not axially in the direction of the longitudinal axis of the shock absorber. The transverse forces which are thereby generated cannot be damped by the shock-absorber, thereby increasing wear of the bumper and damaging it.

It is the underlying purpose of the present invention to further develop a stop module in such a manner that it has a long service life and at the same time requires a small amount of space. The stops and/or bumper elements should thereby experience little wear at different adjustable pivot angles.

SUMMARY OF THE INVENTION

This object is achieved by a stop module comprising the features of the independent claim.

The intermediate element may thereby be supported on the housing either directly or indirectly via a component disposed on the housing. When several intermediate elements are provided, the intermediate element acting against the stop is loaded indirectly by the catch, i.e. via a further intermediate element disposed before the intermediate element.

By providing at least one intermediate element, the transverse forces generated upon impingement of the catch on the intermediate element facing it, are largely diverted into the housing, since the intermediate element is supported on the housing. The intermediate element only passes a force component to the stop, which is perpendicular to the abutment of the intermediate element on the housing. The main force component acting on the stop then extends in the direction of the longitudinal axis of the stop or the axis of motion of the damping element.

In accordance with the invention, the intermediate element or the intermediate elements are thereby freely guided in a substantially annular groove-like recess, at least largely along the trajectory of the catch. The annular groove-like recess is thereby advantageously formed by the housing or corresponding components provided in the housing. The trajectory of the catch is thereby circular or has the shape of a segment of a circle. The catch only impinges on the intermediate element facing it and preferably does not contact any further intermediate elements. This reduces the required space.

In accordance with the invention, the intermediate element is advantageously designed such that the forces exerted on the stop by the intermediate element are transmitted at least largely without transverse forces. Such an intermediate element advantageously has a spherical shape. A spherical shape is particularly suited for transmission or passing on of forces largely without transverse forces.

In a particularly preferred embodiment of the invention, several intermediate elements are provided, which are disposed one behind the other. The intermediate elements are thereby free running and not connected or chained to each other. This changes the pivot angle without changing the position of the stops.

The catch then only impinges on the intermediate element facing the catch. This intermediate element acts against a further intermediate element which, in turn, may act against a further intermediate element. The intermediate element facing the stop transmits the remaining force components, which have not been diverted into the housing by the other intermediate elements, to the stop largely without transverse forces.

In a further development of the invention, the intermediate element(s) is/are guided directly before the stop on a path extending tangentially to the trajectory of the catch and in axial extension of the stop. This prevents the intermediate element, which impinges on the stop, from transferring transverse forces to the stop. The stop or the damping element of the stop are therefore subjected to axial loads only.

In a further advantageous embodiment of the invention, the housing is designed such that the number of intermediate elements can be changed to adjust the pivot angle. The stops for introducing further free running intermediate elements or removing individual intermediate elements provided in the housing may thereby be detachable. Towards this end, the housing has e.g. openings in which the stops are disposed.

When the stops have been removed, the intermediate elements can be inserted into or removed from the openings.

The stop or, when several stops are provided, all stops may be disposed on the housing to be axially adjustable for fine adjustment of the pivot angles. The stops may be screwed into the housing at different depths to change the position of the stop relative to the catch.

A total of two stops are advantageously provided in the trajectory of the catch to delimit the pivot motion of the catch in both directions of motion. The two stops may e.g. subtend an angle of 180° or more on the circular trajectory. The respective pivot angle may then be roughly adjusted in dependence on the number of intermediate elements in the trajectory and can be finely adjusted through insertion and fixing the stops in the housing at different depths.

In accordance with the invention, the stop advantageously comprises a fixed stop and a damper, wherein the damper damps the motion of the catch before the catch impinges on the fixed stop. It is thereby advantageous for the damper to be made from elastically resilient plastic material, in particular elastomeric material. The fixed stop may thereby surround the damper like a sleeve, wherein the damper projects axially past the fixed stop in the unloaded state. When the intermediate element impinges on the stop, the damper is consequently initially elastically axially compressed until the intermediate element impinges on the fixed stop, which surrounds the damper like a sleeve. A cylinder piston damper may clearly This provides a relatively large support surface of the intermediate element on the fixed stop to prevent tension peaks in the fixed stop and in the intermediate element. The service life of the stop and the intermediate elements is thereby increased.

The above-mentioned object is also achieved by a pivot unit comprising an inventive stop module.

Further details and advantageous embodiments of the invention can be extracted from the following description which describes and explains the invention in more detail with reference to the embodiments shown in the drawing.

DESCRIPTION OF THE PREFERRED EMBODIMENT

Figure 1:
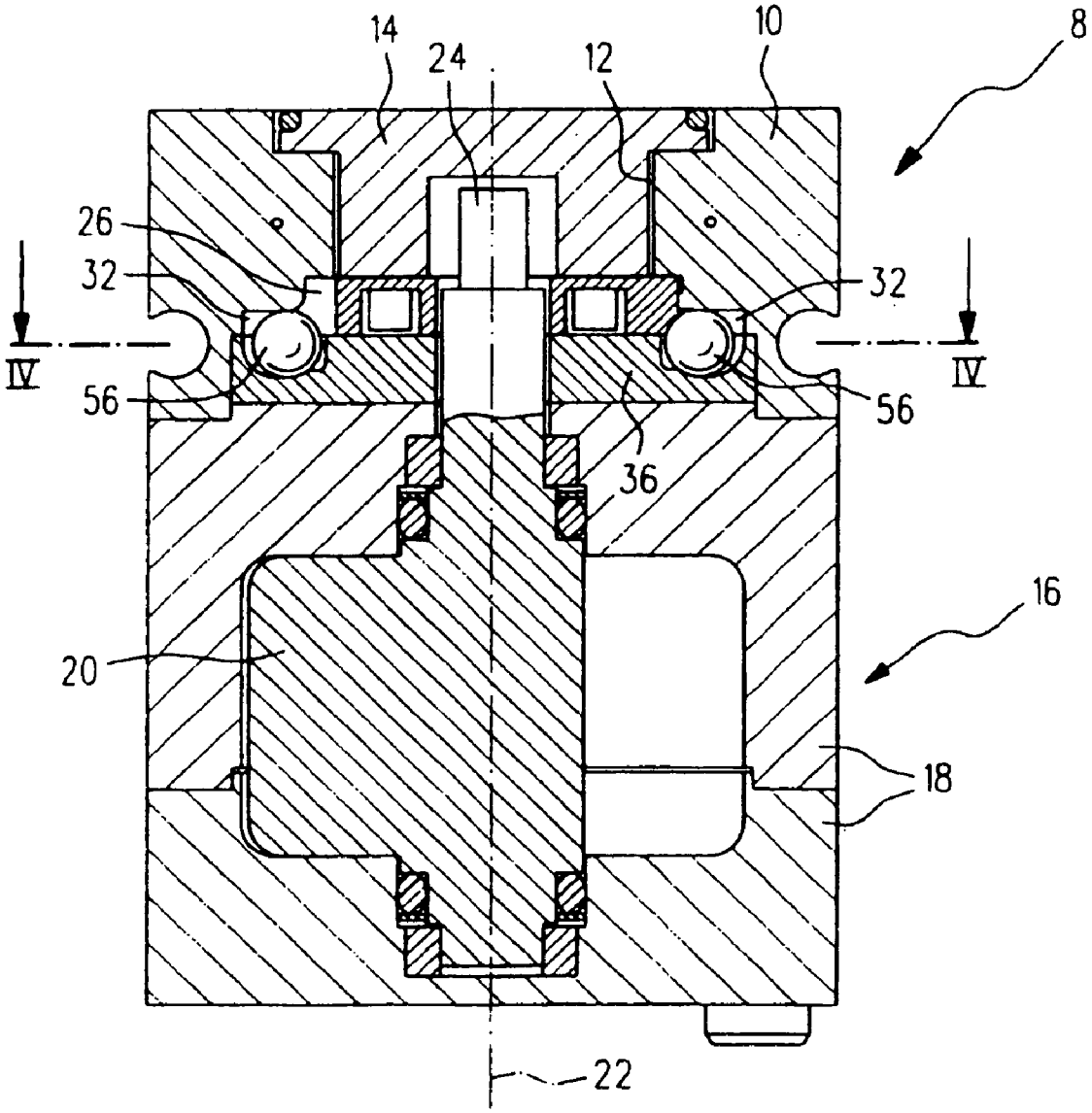
FIG. 1 shows a longitudinal section through an inventive stop module.

FIG. 1 shows an inventive stop module 8 with a housing 10, which has a central opening 12. A rotation body 14 is disposed in the central opening 12 and can be pivoted relative to the housing 10. Pivotable components, such as e.g. grippers, may be disposed on the rotation body 14.

A pivot drive 16 in the form of an impeller drive is shown on the lower side of the housing 10. The pivot drive 16 comprises a two-part housing 18 which accommodates a pneumatically loadable pivot impeller 20. The pivot impeller 20 may be loaded on either side by compressed air, thereby pivoting the pivot impeller 20 about the axis 22. The pivot impeller 20 has a pivot shaft 24 on its side facing the stop module 8, which is rotationally coupled to the rotation body 14. Pivoting of the pivot shaft 24 consequently also pivots the rotation body 14.

Figure 3:
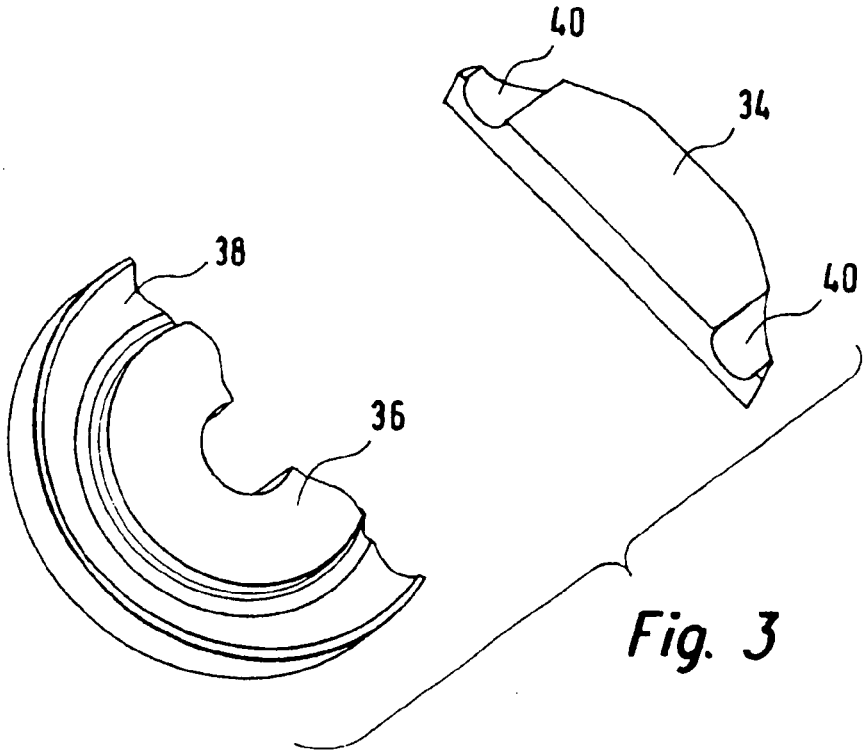
FIG. 3 shows insertion components for the housing in accordance with FIG. 2.

The pivot motion of the rotation body 14 is delimited by a catch 26 provided on the rotation body 14, which can move between two stops on the housing side. The stops are designated with reference numerals 48 and 50 in FIGS. 4*a* and 4*b*. The catch 26 projects into an annular recess 32 on the housing side. The recess 32 is formed by the housing 10 and also by two components 34, 36 which are shown in a perspective view in FIG. 3.

The circular disk-shaped component 36 has an annular groove 38 which is joined in its extension by a straight groove 40 adjoining the component 36 in a tangential direction.

Figure 2:
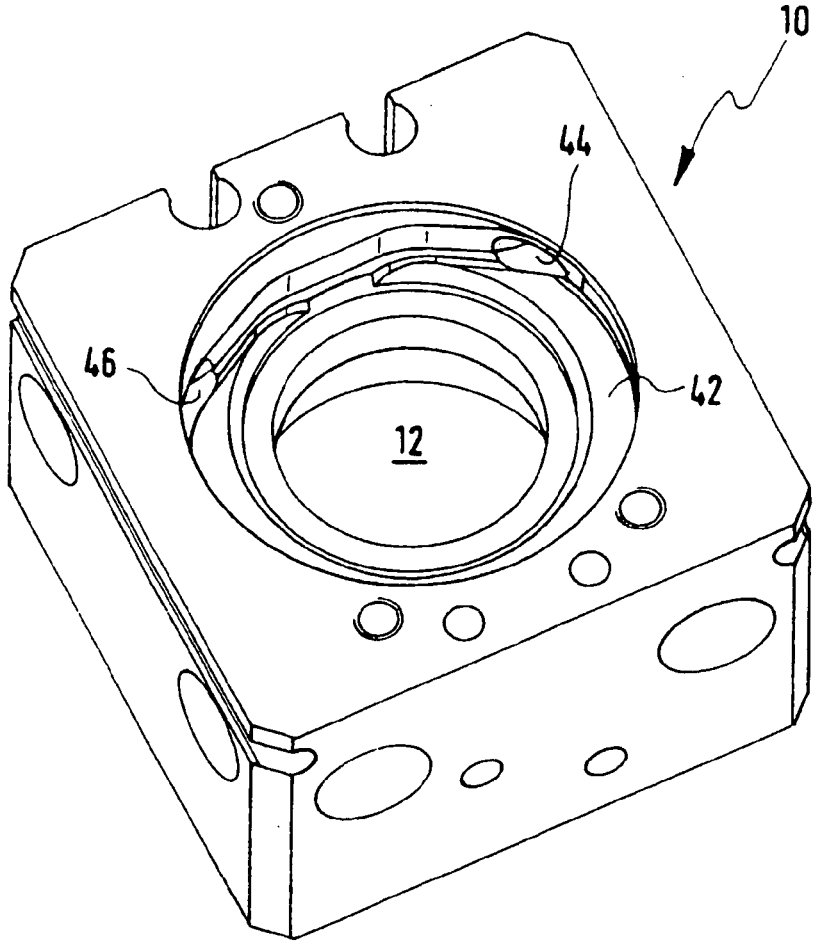
FIG. 2 shows a perspective lower view of the housing of the stop module in accordance with FIG. 1.

The two components 36, 38 are received on the lower side (FIG. 2) of the housing 10 in the assembled state. The housing 10 has a collar-like web 42 in the region of the central opening 12, onto which the open side of the annular groove 38 of the component 36 is disposed. The component 34 is correspondingly inserted, such that the grooves 40 are disposed in the extension of the grooves 38. In the extension of the grooves 40, the housing 10 has two parallel openings 44, 46, which can be accessed from the outer side of the housing and receive the stops 48, 50.

Figure 4A:
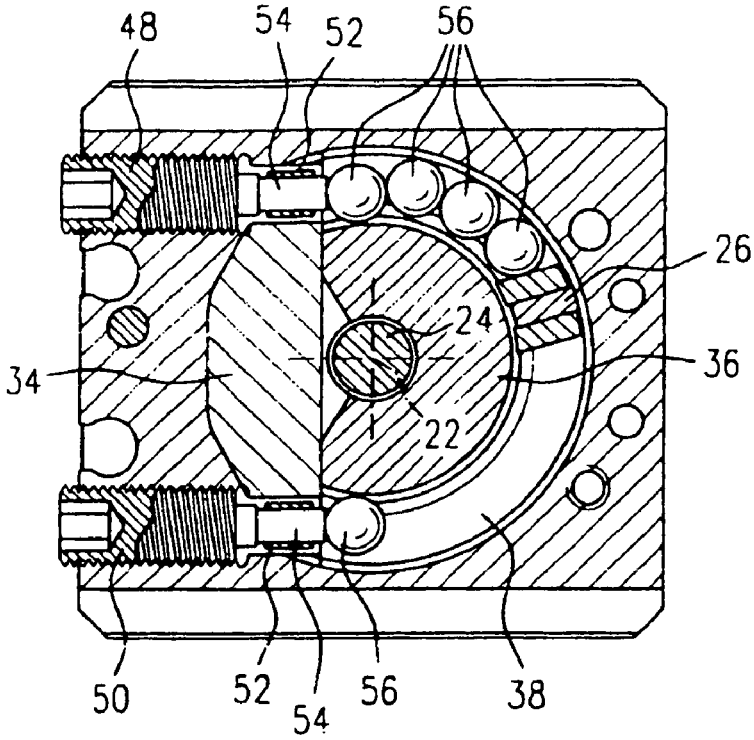
FIG. 4*a* shows a cross-section along line IV-IV in accordance with FIG. 1 of a first inventive embodiment.
Figure 4B:
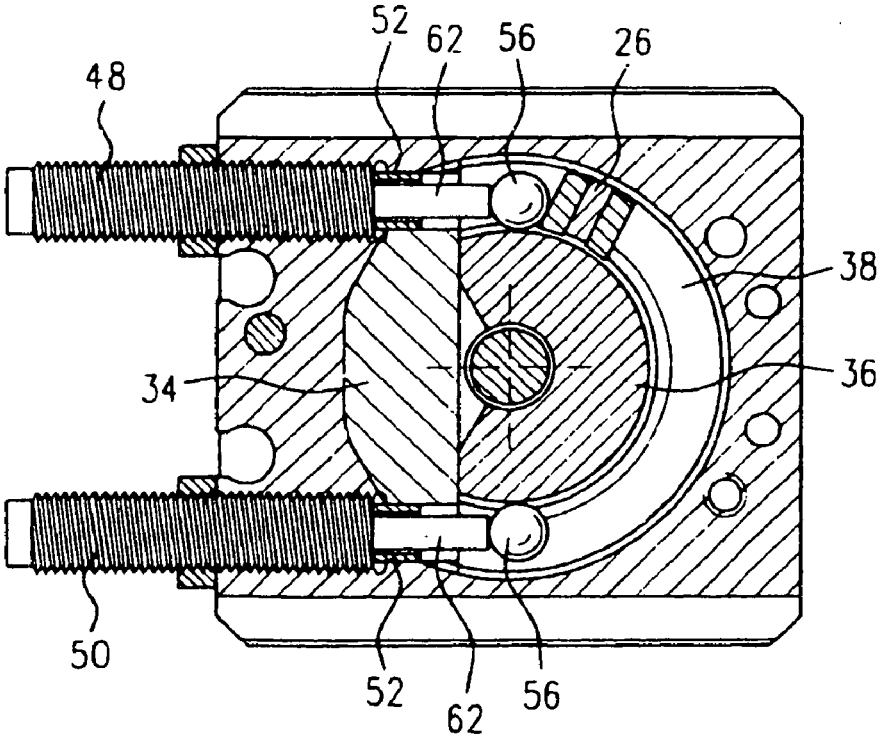
FIG. 4*b* shows a cross-section along line IV-IV in accordance with FIG. 1 of a second inventive embodiment.

The section of FIGS. 4*a* and 4*b* is selected to be in the region of the annular groove 38, the grooves 40, and the openings 44, 46.

In the embodiment of FIG. 4*a*, the stops 48, 50, which are screwed into the openings 44, 46, have a sleeve-like fixed stop 52 and a damper 54 of elastomeric material surrounded by the fixed stop 52. The damper 54 projects past the solid stop 52 in the unloaded state.

The sectional view of FIG. 4*a* clearly shows the axis of rotation 22 about which the pivot shaft 24 can be pivoted together with the catch 26. The catch 26 thereby engages the recess 32 or the annular groove 38. Free running intermediate elements which have the shape of balls 56 and are not motionally coupled, are provided between the catch 26 and the stops 48, 50.

In the embodiment of FIG. 4*a*, four balls 56 are shown between the stop 46 and the catch 26, and only one ball between the catch 36 and the stop 50. The pivot angle can be roughly adjusted by the respective number of balls 56 between the stop 48, 50 and the catch 26. Fine adjustment of the pivot angle is effected by screwing in the stops 48, 50 to different depths.

The individual free running balls 56 are each supported on the housing 10 or the component 38 on the housing side when loaded by the catch.

The motion of the catch 26 is limited by the balls 56. When the catch 26 is pivoted in the direction of the four balls, the ball 56.4 facing the stop 48 impinges on the damping element 54 which is elastically deformed until the ball strikes the fixed stop 52.

FIG. 4*b* shows stops 48, 50 which comprise a damper 54 in the form of a pretensioned piston rod 62 which can be axially displaced. The two axially displaceable piston rods 62 of the two stops 48, 50 are each surrounded by a fixed sleeve-like stop 52 which diverts forces into the stops 48, 50 upon impingement.

The pivot angle of the catch 26 in accordance with FIG. 4*b* is approximately 180°. In this case, only one ball 56 is provided between the catch and the stop 48, 50.

The pivot angle of FIG. 4*a* is approximately 120°. Four balls 56 are provided between the catch 26 and the stop 48 and one ball is provided between the catch 26 and the stop 50.

When the stops 48, 50 have been removed, the balls can be inserted into or removed from the openings 44, 46.

The longitudinal axes of the fixed stops 48 and 50 extend in parallel in accordance with FIGS. 4*a* and 4*b*. When a pivot angle of more than 180° is desired, the two stops 48, 50 may be disposed not parallel but at an angle with respect to each other.

Figure 5:
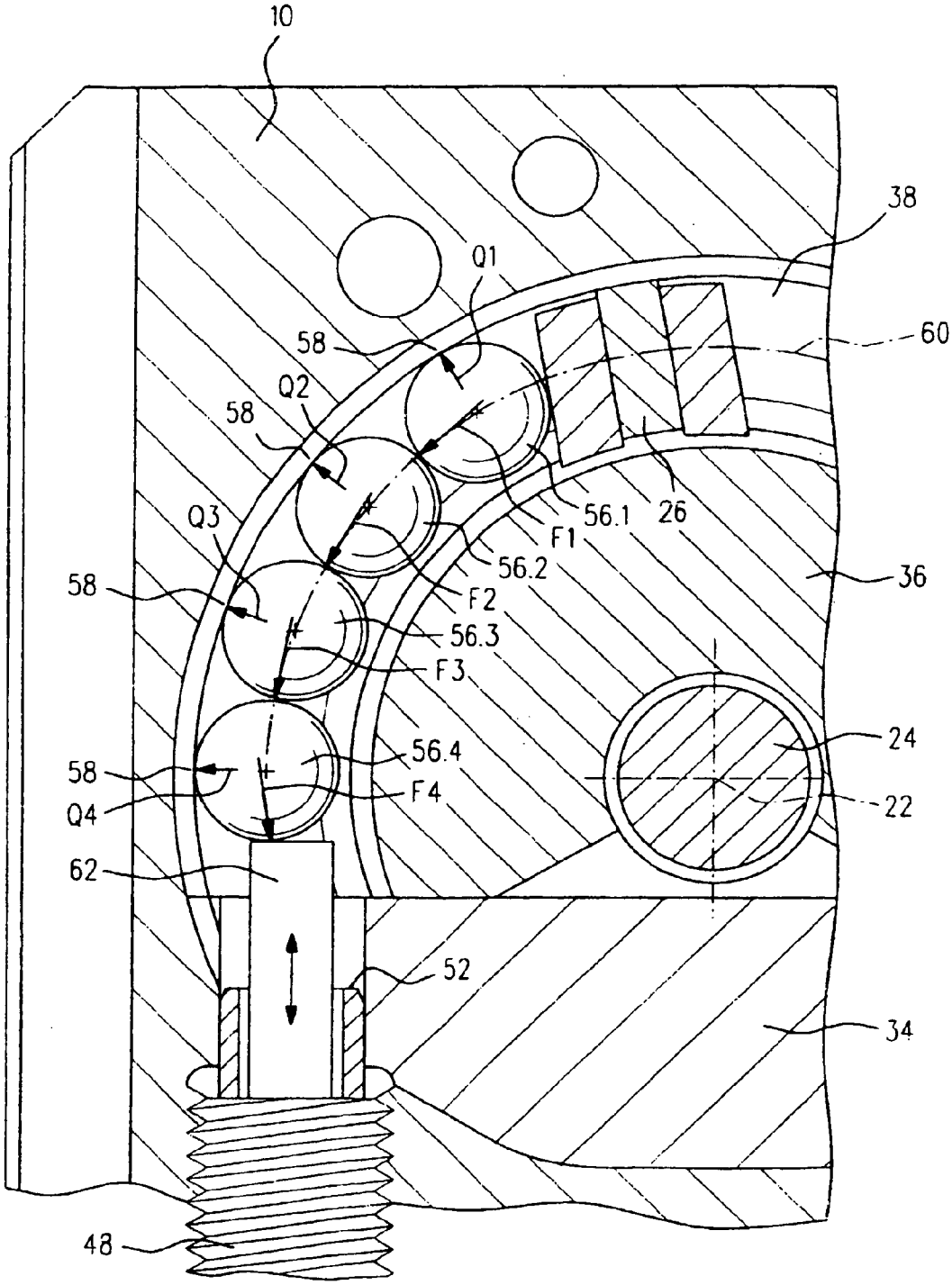
FIG. 5 shows an enlarged section of FIG. 4*a*.

FIG. 5 shows the force flow when the catch 26 impinges on the ball 56.1 facing the catch 26. The individual balls 56 each transmit forces $F_1$ through $F_4$ only perpendicularly to their respective abutment location 58 housing at abutment locations 58. Only a tangential force $F_1$ through $F_4$ directed perpendicularly to the transverse force $Q_1$ through $Q_4$ is then transferred to the respectively next ball 56 along the trajectory 60 of the catch 26. The damper disposed in the trajectory 60 of the catch 26 or its piston rod 62 is consequently loaded with the resulting tangential force $F_4$, largely without transverse forces. The direction of the force $F_4$ acting on the piston rod 62 and damper 54 is thereby independent of the number of balls 56 between the damper 54 and the catch 26. The direction of force $F_4$ changes only slightly with the insertion depth of the respective stop 48, 50. By providing the balls 56, the forces F acting on the stop 48, 50 or damper 54, 62 are largely free from transverse forces Q. This loads the damper 54, 62 in a largely axial direction. The damper 54, 62 is consequently largely uniformly loaded irrespective of the pivot angle to be adjusted. The pivot angle can also be changed in a simple fashion, i.e. through changing the number of balls 56 and/or changing the insertion depth of the stops 48, 50.

The invention claimed is:

1. A stop module for delimiting a pivot motion, the module comprising:

a housing having a substantially annular recess;

a rotation body pivotably disposed in said housing, said rotation body having a catch disposed on a side thereof, said catch having a trajectory following the pivot motion;

a stop disposed on a side of said housing and having a damping element for delimiting a motion of said catch, said stop being disposed in a circular or circular segment-shaped portion of said trajectory of said catch; and at least one spherical intermediate element disposed between said catch and said stop and substantially freely guided along said trajectory of said catch within said recess, said intermediate element being supported on said housing and also on said stop when said catch impinges.

2. The stop module of claim 1, wherein said intermediate element is designed such that forces exerted by said intermediate element onto said stop are transmitted tangentially to said trajectory of said catch.

3. The stop module of claim 1, wherein several free running intermediate elements are disposed next to each other.

4. The stop module of claim 3, wherein all intermediate elements have identical design.

5. The stop module of claim 1, wherein said intermediate element is guided in a direct vicinity of said stop along a path extending tangentially to said trajectory of said catch and in axial extension of said stop.

6. The stop module of claim 1, wherein said housing is designed such that a number of intermediate elements can be changed to adjust a pivot angle.

7. The stop module of claim 1, wherein said stop is adjustably disposed on said housing to adjust a pivot angle.

8. The stop module of claim 1, wherein two stops are disposed in said trajectory of said catch for delimiting a pivot motion in both directions thereof.

9. The stop module of claim 1, wherein said stop comprises a fixed stop, wherein said damper element damps a motion of said catch before said catch impinges on said fixed stop.

10. The stop module of claim 9, wherein said damper element comprises an elastically resilient plastic material, an elastomeric material, or a piston rod of a damping piston.

11. The stop module of claim 9, wherein said fixed stop surrounds said damper element, wherein said damper element projects past said fixed stop in an axial direction.

12. A pivot unit comprising:

a housing having a substantially annular recess;

a rotation body pivotably disposed in said housing, said rotation body having a catch disposed on a side thereof, said catch having a trajectory following a pivot motion;

a drive mechanism cooperating with said rotation body;

a stop disposed on a side of said housing and having a damping element for delimiting a motion of said catch, said stop being disposed in a circular or circular segment-shaped portion of said trajectory of said catch; and at least one spherical intermediate element disposed between said catch and said stop and substantially freely guided along said trajectory of said catch within said recess, said intermediate element being supported on said housing and also on said stop when said catch impinges.

* * * * *